United States Patent [19]

Hurt et al.

[11] Patent Number: 4,530,174

[45] Date of Patent: Jul. 23, 1985

[54] DRIVE FOR ELEVATING MECHANISM

[75] Inventors: Henry W. Hurt; Charles F. May, both of Lubbock, Tex.

[73] Assignee: John Barryman Reynolds, Lubbock, Tex. ; a part interest

[21] Appl. No.: 638,604

[22] Filed: Aug. 7, 1984

[51] Int. Cl.[3] ..... B60P 1/36

[52] U.S. Cl. ..... 37/8; 37/DIG. 7; 418/150; 198/854

[58] Field of Search ..... 37/8, DIG. 7, 191 A; 418/150, 221; 198/854

[56] References Cited

U.S. PATENT DOCUMENTS 3,758,966 9/1973 Miller ..... 37/8

*Primary Examiner*—E. H. Eickholt

*Attorney, Agent, or Firm*—Dowell & Dowell

[57] ABSTRACT

The elevating mechanism for a scraper is driven directly and without any supplementary inertia mechanism or speed reducing mechanism by a hydraulic motor of a type having concentrically mounted rotating and stationary members, and with substantial numbers of stator cavities and rotor vanes, each of which vanes works in each stator cavity once per revolution, thereby producing the number of power strokes per revolution equal to their multiplied product, thereby giving it the ability at low speeds and at high torque to distribute and withstand high shock loads as occurs when each flight of the elevating mechanism engages material.

4 Claims, 4 Drawing Figures

Fig. 1
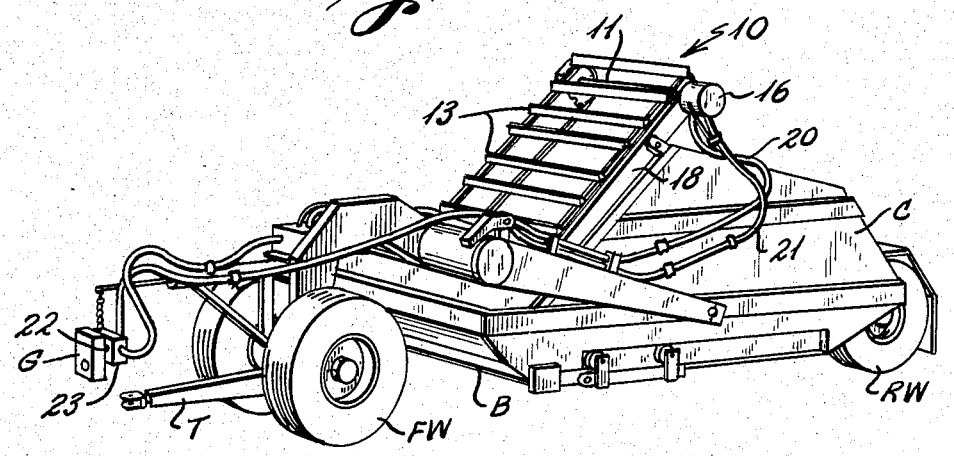
Fig. 2
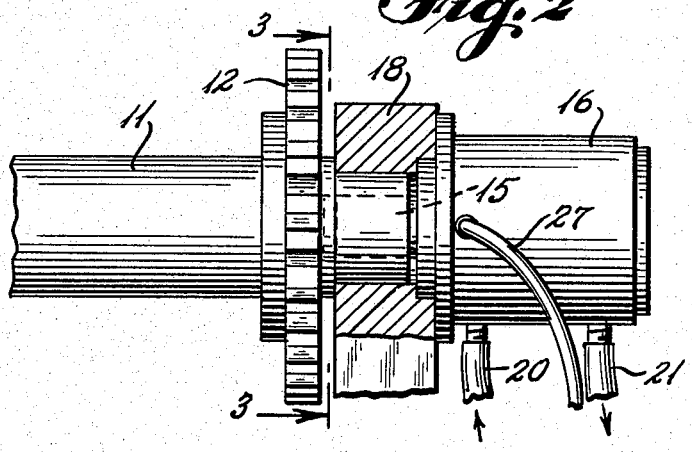
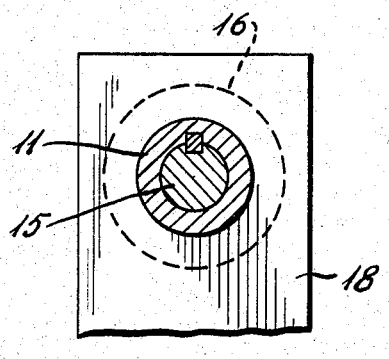
Fig. 3

DRIVE FOR ELEVATING MECHANISM

BACKGROUND OF THE INVENTION

1. Field of the Invention

This invention is in the field of power supply and transmittal to a load that is characterized by highly variable peaks and valleys.

The invention is particularly useful in the field of earth scrapers which move along the surface of the earth in order to remove a portion thereof and at the same time an elevating mechanism carries the loosened earth and other materials upwardly into a container.

2. Description of the Prior Art

The patent to Johnson et al. U.S. Pat. No. 3,208,165 discloses an earth scraper with a hydraulically operated conveyor. Johnson discusses the problems that occur in the operation of the conveyor in this type of mechanism. Johnson found that destructive pressure surges of up to 4,000 lbs. per square inch developed each time a flight engaged the loosened dirt. He found that even if he increased the horsepower of the system with a corresponding increase in cost that pressure surges occurred of a destructive nature to the flexible hoses and ultimately to the pump and motor. Johnson proposed to overcome these problems by using a relatively high RPM motor with a gear reduction unit and a relatively heavy flywheel. Using this arrangement Johnson stated that pressure within the system remained substantially constant at 1400 psi with variations of only 200 psi occurring upon engagement of a flight with the loosened dirt. (See Column 5, line 26 to Column 6, line 2).

The teaching of the Johnson patent has been followed through the years up to the present by the industry. Thus, it appears that Johnson has licensed his patent to the major manufacturers of equipment of this nature and that the practice described in his patent has become and remains the standard in the art up to the present time despite the fact that Johnson's system has disadvantages of serious nature. These disadvantages include the relatively high initial cost, and the relatively high maintenance and repair parts problem associated with the high-speed inertia drive system. Thus, if the elevator is stopped suddenly as when the mechanism encounters a large rock, a tree stump, or similar object, the inertia from the flywheel may cause damage to the chain, the flight paddle, other parts of the elevator, or associated mechanism.

It should also be observed that motors of the type manufactured by Rineer Hydraulics, Inc., and used in the combination of the present invention, have been known for many years, the U.S. Pat. No. 3,672,797 for example having been filed Dec. 10, 1969. Such motors have been available on the market for years and the manufacturer has published a description of numerous applications in which such motors are being used, but this does not include the application of the present invention.

Hydraulic drives used in various mechanisms are also disclosed in the U.S. Pat. Nos. to Henry et al. 2,195,308; Twyman 2,301,098; Kopp 2,468,828; Banister et al. 2,658,342; Logus 2,708,800; Amthor et al. 2,894,341; Davis 2,815,047; Allard 3,043,029; Schmidt 3,094,795; Brinkmeyer et al. 3,143,814, Schneider 3,949,553; Yoshioka 3,978,665; and Stieger 4,194,360.

SUMMARY OF THE INVENTION

The present invention includes the combining of an elevating mechanism that is subjected to sudden variations in load, as described in the Johnson et al. U.S. Pat. No. 3,208,165, with a direct drive relatively low-speed multiple power stroke high torque vane type motor of the type described in the Gerlach et al. U.S. Pat. No. 3,672,797, or Gerlach 3,957,404, as contrasted with the relatively high-speed motor having an associated gear driven flywheel, as in the Johnson patent.

BRIEF DESCRIPTION OF THE DRAWINGS

A preferred embodiment of the invention is illustrated in the drawings in which

FIG. 1 is a perspective view of an earth scraper having the invention embodied therein.

FIG. 2 is an enlargement, partly in section, showing the connection of the hydraulic motor to the sprocket shaft.

FIG. 3 is a section on the line 3—3 of FIG. 2.

DESCRIPTION OF THE PREFERRED EMBODIMENT

Figure 4:
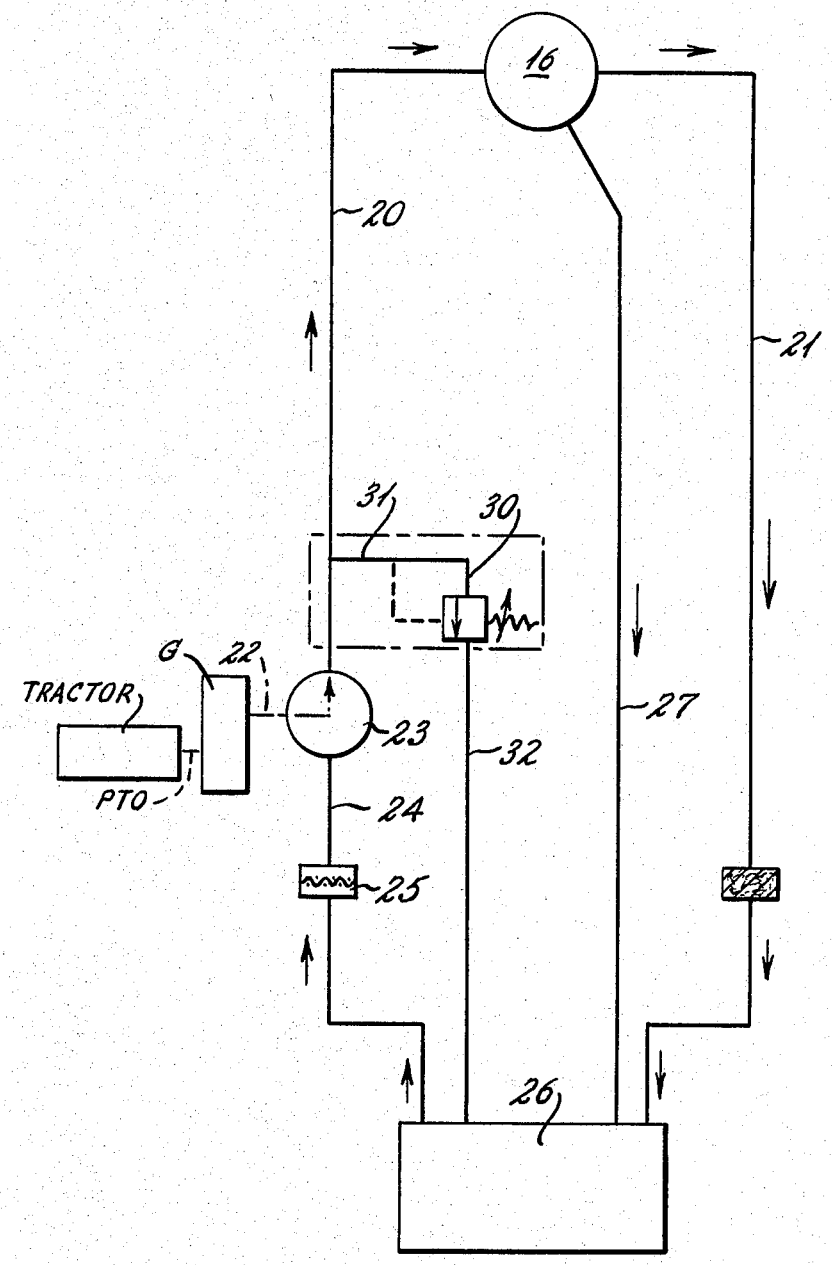
FIG. 4 is a schematic of the hydraulic circuit.

With further reference to the drawing there is illustrated an earth scraper having a tow bar T, a front wheel unit FW, and a rear wheel unit RW carrying a container C for receiving earth that is scooped by a leading cutter blade B as the mechanism is towed by a tractor, not shown.

During the forward movement of the device a conveyor mechanism 10 having a shaft 11 which mounts a sprocket 12 and which carries spaced flights 13 of scraper blades is moved to raise the loosened dirt and carry it upwardly into the container.

The shaft 11 is keyed to the output shaft 15 of a hydraulic motor 16 which will be described in detail later. The motor housing has a mounting flange that is mounted on left side frame member 18, the other end of shaft 11 being suitably journaled in a similar right side frame member. The motor 16 has an inlet line 20 and an outlet line 21 which is connected to the supply tank.

With reference to FIG. 4, the drive mechanism hydraulic system is illustrated. Thus, the tractor has a power takeoff shaft which drives through a speed increaser G a shaft 22 which drives a hydraulic pump 23.

The hydraulic pump has an inlet line 24 through a strainer 25 and connected to a tank 26. The outlet line 20 from the pump is connected to a relief valve 30 by bypass lines 31 and 32 to the tank 26. The relief valve 30 has a condition responsive means whereby it opens in the event that the pressure in the line 20 reaches a predetermined level. The motor also has a bleed line 27 to the tank 26 to accommodate internal lubrication of the motor.

The motor 16 is of the type which is more fully described in the Gerlach et al. U.S. Pat. No. 3,672,797, or the Gerlach U.S. Pat. No. 3,957,404. As more fully described in those patents the motor has bi-directional capability with concentrically mounted rotating and stationary members, working vanes in slots in a rotating member and sealing vanes in slots in the stationary member, with a fluid inlet in the stationary member adjacent one side of each slot therein and a fluid outlet in the stationary member adjacent the other side of each slot therein.

The particular motor that has been selected for use which is of the type described in six stator cavities and sixteen rotor vanes. Since each rotor vane works in each stator cavity once per revolution the motor has ninety-six power strokes per revolution.

Although various operating conditions may be selected, we have found that preferred results are obtained if shaft 11 is operated at 49 RPM, at which the flights engage the ground at a rate of 172 per minute.

The operation of the selected motor as compared with that in the Johnson patent may be made. Thus, Johnson observed pressure surges up to 4,000 lbs. per square inch each time a conveyor flight engaged the loosened dirt when operating the 30 horsepower hydraulic system using a 1,450 RPM motor and a 22.1 gear reduction. When Johnson added a 55 lb. flywheel having a diameter of 11¾" he found that the pressure within the system remained substantially constant at 1,400 lbs. per square inch with variations of only 200 lbs. per square inch occurring upon engagement of a flight with the loosened dirt.

Applicant has found that when using the particular motor described a system pressure of approximately 500 to 1000 psi is required to drive the elevator as it loads the loosened dirt. No noticeable fluctuations in pressure are observed during normal operation when the conveyor flights engage the loosened dirt. This is believed to be attributable to the internal design of the particular motor such that there is an absence of pressure surges due to the large number of power strokes per revolution of the motor. Furthermore, testing and checking of the motor in this system indicates an absence of problems from wear.

In addition applicant has found that during normal operation approximately 9 horsepower is required to drive the conveyor at an RPM of only 49, and during which the pressure is 500 lbs. per square inch.

In the event that usually heavy loads are encountered, such as from rocks, stumps, or an excessive accumulation of weeds or other material, the pressure rises to accommodate the increase in load. Applicant prefers to set the bypass 30 to relieve the pressure at approximately 3500 psi corresponding to the pressure at which the conveyor stalls. This protects the conveyor and the pump and hydraulic system from damage due to overload. Furthermore, at high loads below stalling the motor is able to absorb the shocks therefrom as each flight engages the material or object, due to its unique structure and operation.

I claim:

1. Earth moving apparatus comprising a mobile open front dirt carrying container, a scraper blade carried by said container, an endless rigid frame scraper type conveyor carried by said container and having a plurality of flights which sequentially dig into the earth which passes the scraper blade for moving dirt upwardly and rearwardly into said container, a hydraulic motor of the type having a housing and bi-directional capability, said motor having concentrically mounted rotating and stationary members, working vanes in slots in the rotating member, sealing vanes in slots in the stationary member, the stationary member having a plurality of cavities in which the rotating member vanes work, the rotating member having a plurality of vanes, a fluid inlet in the stationary member adjacent one side of each slot therein, a fluid outlet in the stationary member adjacent the other side of each slot therein, whereby the number of power strokes per revolution is the multiplied product of the number of stationary member cavities and the number of vanes on the rotating member, said conveyor having a driven element carried on a shaft for driving the conveyor, said shaft carried on said frame, said motor having an output shaft driven by its rotating member, means mounting said motor housing coaxially with said conveyor shaft, and means directly connecting said motor shaft and said conveyor shaft.

2. The invention of claim 1, pump means for pumping hydraulic fluid to said hydraulic motor, said pump means driven from an external power source, said pump means connected by a first line to a source of hydraulic fluid and by a second line to said motor, said motor connected by a third line to said source of hydraulic fluid, relief valve means in said second line, and means connecting said relief valve means to said source of hydraulic fluid, said relief valve means opening automatically in response to a predetermined pressure in said second line.

3. The invention of claim 1, in which said stationary member has six cavities and said rotating member has sixteen vanes.

4. The invention of claim 1 in which said motor is the type described in either United States patent to Gerlach et al. U.S. Pat. No. 3,672,797, or Gerlach U.S. Pat. No. 3,957,404.

* * * * *

UNITED STATES PATENT AND TRADEMARK OFFICE

CERTIFICATE OF CORRECTION

PATENT NO. : 4,530,174

DATED : July 23, 1985

INVENTOR(S) : Henry W. Hurt; Charles F. May

It is certified that error appears in the above-identified patent and that said Letters Patent are hereby corrected as shown below:

"References Cited" is amended to include the following:

U.S. PATENT DOCUMENTS

| | | | |
|---|---|---|---|
| 2,195,306 | 3/26/40 | A.R. Henry et al. | |
| 2,301,098 | 11/03/42 | R. Twyman | |
| 2,468,828 | 5/03/49 | H.A. Kopp | |
| 2,658,342 | 11/10/53 | G. Banister et al. | |
| 2,708,800 | 5/24/55 | A. T. Logus | |
| 2,815,048 | 12/22/55 | G. Davis | |
| 2,894,341 | 10/05/53 | W.M. Amthor et al. | |
| 2,992,616 | 7/18/61 | A.E. Rineer | |
| 3,016,020 | 1/09/62 | A.E. Rineer | |
| 3,016,021 | 1/09/62 | A.E. Rineer | |
| 3,043,029 | 9/03/59 | P.Jean-Marie Theodore Allard | |
| 3,094,795 | 6/25/63 | Schmidt | 37/67 |
| 3,143,814 | 8/11/64 | Brinkmeyer et al. | 37/8 |
| 3,208,165 | 9/28/65 | Johnson et al. | 37/8 |
| 3,672,797 | 6/27/72 | Gerlach et al. | 418/125 |
| 3,782,867 | 1/01/74 | Gerlach et al. | 418/82 |
| 3,949,553 | 4/13/76 | Schneider | 60/325 |
| 3,957,404 | 5/18/76 | Gerlach | 418/150 |
| 3,978,665 | 9/07/76 | Yoshioka | 60/325 |
| 4,194,360 | 3/25/80 | Stieger | 60/325 |

OTHER PRIOR ART

RINEER HYDRAULICS, INC. 12/3/83
Ltr. Rineer Hydraulics, Inc. to its Distributors with Attachment titled "APPLICATIONS" 3/23/83
TEREX S-23E SCRAPER, Booklet
TEREX S-23E SCRAPER, Booklet

UNITED STATES PATENT AND TRADEMARK OFFICE

CERTIFICATE OF CORRECTION

PATENT NO. : 4,530,174

DATED : July 23, 1985

INVENTOR(S) : Henry W. Hurt; Charles F. May

It is certified that error appears in the above-identified patent and that said Letters Patent are hereby corrected as shown below:

CATERPILLAR, Booklet
JOHN DEERE 762A, Booklet
JOHN DEERE, TAKING OVER, Booklet 10/31/80
Construction Equipment 5/15/83, 1983-84 BUYERS GUIDE FIATALLIS Signed and Sealed this

*Twenty-sixth* Day of *November 1985*

[SEAL]

*Attest:*

DONALD J. QUIGG

*Attesting Officer*

*Commissioner of Patents and Trademarks*